US005137008A

United States Patent [19]

Taylor

[11] Patent Number: 5,137,008

[45] Date of Patent: Aug. 11, 1992

[54] ARM GUARD

[76] Inventor: Anthony Taylor, Rte. 1, Box 25, Pleasant Hope, Mo. 64725

[21] Appl. No.: 618,682

[22] Filed: Nov. 26, 1990

[51] Int. Cl.[5] ..... F41B 5/00

[52] U.S. Cl. ..... 124/88; 124/23.1

[58] Field of Search ..... 124/88, 86, 23.1, 89, 124/24.1

[56] References Cited

U.S. PATENT DOCUMENTS

| | | | |
|---|---|---|---|
| 2,816,537 | 12/1957 | Irwin . | |
| 3,015,328 | 1/1962 | Ryder | 124/24.1 X |
| 3,167,062 | 1/1965 | Zwickey . | |
| 4,027,645 | 6/1977 | Damron . | |
| 4,332,231 | 6/1982 | Napier et al. | 124/88 X |
| 4,343,286 | 8/1982 | Thacker . | |
| 4,377,152 | 3/1983 | Saunders | 124/23.1 X |
| 4,452,222 | 6/1984 | Quartino et al. | 124/88 X |
| 4,457,287 | 7/1984 | Babington . | |
| 4,787,361 | 11/1988 | Vyprachticky . | |
| 4,919,107 | 4/1990 | Bunts | 124/88 X |
| 4,957,093 | 9/1990 | Hamlett | 124/88 X |
| 5,002,035 | 3/1991 | Brooks | 124/88 X |

*Primary Examiner*—Peter M. Cuomo
*Attorney, Agent, or Firm*—Michael Yakimo, Jr.

[57] ABSTRACT

A forearm protector for use with an archery bow comprising a mounting plate with a mounting strut extending therefrom. A forearm guard is pivotally mounted to the mounting strut in pivotal vertical movement. The mounting plate includes a plurality of vertically and laterally aligned apertures or slots for alignment with a conventional accessory aperture found in the limb of a compound bow. A threadable pin engages the bow aperture with the mounting plate inserted therebetween. A coupling nut engages the free end of the pin so as to present another accessory aperture. The plurality of apertures allows the protector to be adjusted in lateral and vertical directions relative to the bow. This adjustment cooperates with the pivotal vertical adjustment of the guard to allow the archer to selectably position the protector relative to the bow and relative to the forearm. Alternative embodiments which respectively utilize an angled forearm guard and a rotatable adjustment of a protector plate for the forearm are also disclosed.

14 Claims, 3 Drawing Sheets

ARM GUARD

BACKGROUND OF THE INVENTION

This invention relates to the art of archery, and more particularly, to an arm guard for protecting the forearm of the user during archery bow use.

Upon shooting any type of archery bow, the central stretch of the bowstring, as drawn to a full draw position, may strike and chafe the archer's forearm upon release of the bowstring to drive the arrow towards the target. Such an action may also cause the archer's arm to flinch or otherwise move which may further thrust the bow and divert the arrow from the target.

To avoid such problems, protectors have been devised which may be either worn on the archer's forearm or otherwise attached to the bow proper. However, many of these devices are relatively complex in structure and produce unwanted side thrust forces on the arrow shaft. Moreover, some of these devices may be difficult to utilize, difficult to mount and may not be adjustable relative to various bow and/or archer's forearm sizes.

In response thereto, I have invented an arm guard having an efficient design which is easily, releasably mounted to an archery bow. The device comprises an arm with mounting flange having a plurality of mounting apertures. The device is releasably attached to the stabilizer aperture found in a bow limb with a conventional set screw. The forearm protector includes a pivotally mounted arm guard which can be angularly adjusted. The archer may press his forearm against the guard which helps to stabilize the bow during use. The device is easily adaptable for use with various types of bow configurations as well as for left handed or right handed archery bows. Alternative embodiments utilizing similar structure are also disclosed.

Accordingly, it is a general object of this invention to provide a forearm protector for an archery bow.

Another object of this invention is to provide a protector, as aforesaid, which is easily releasably attached to an archery bow.

A still further object of this invention is to provide a protector, as aforesaid, which is easily attached for use with bows of various configurations and to either left hand or right hand archery bows.

Another object of this invention is to provide a protector, as aforesaid, which has a guard angularly adjustable relative to the arm of the user.

A further object of this invention is to provide a protector, as aforesaid, which has a guard for contact with the arm of the user to help stabilize the bow during use.

Still another particular object of this invention is to provide a protector, as aforesaid, which diminishes the resulting side thrust on the bow upon shooting the arrow.

A further object of this invention is to provide a protector, as aforesaid, which is efficient in design, simple to manufacture and effective in use.

Another particular object of this invention is to provide a protector, as aforesaid, which is mounted to the accessory aperture of an archery bow but does not preclude the use of conventional accessories.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
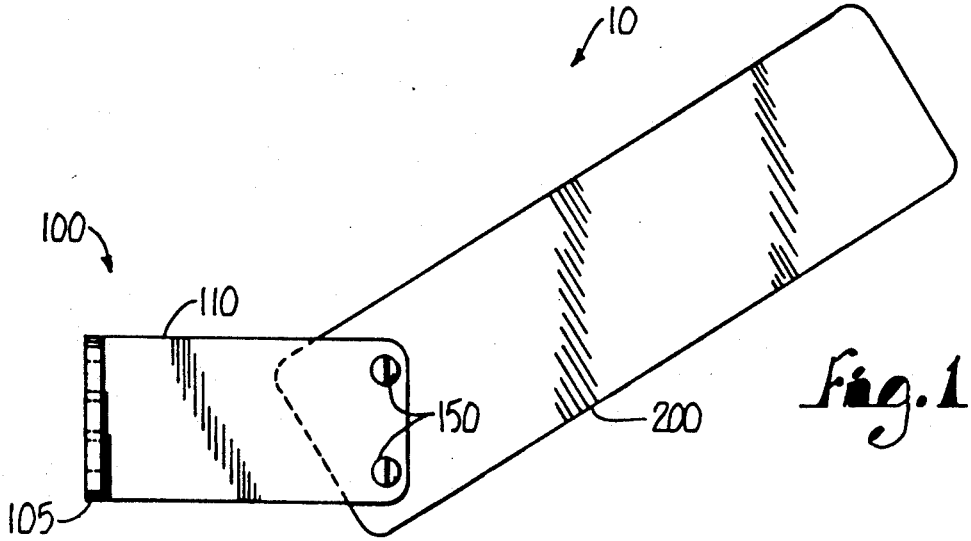
FIG. 1 is a side elevation view of the forearm protector.
Figure 2:
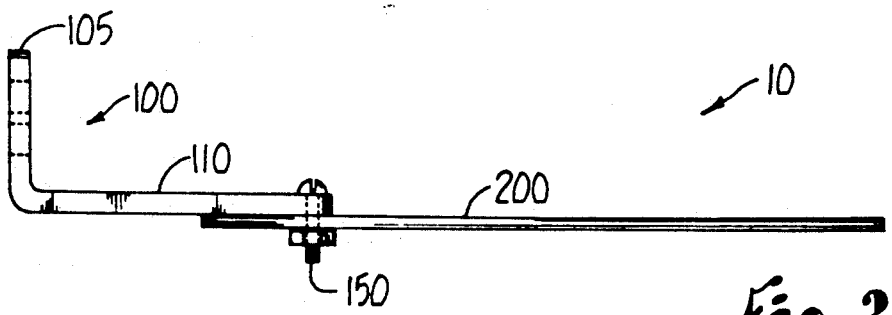
FIG. 2 is a top view of the forearm protector.

Turning more particularly to the drawings, FIG. 1 illustrates a protector 10 as having a mounting arm 100 and an arm guard 200 pivotally attached thereto by means of bolt/nut 150 attachments.

The mounting arm 100 includes a front mounting plate 105 with a mounting strut 110 normally projecting therefrom. The mounting plate 105 includes a plurality of apertures 120 aligned in vertical and horizontal directions. These apertures 120 are designed for alignment with an accessory aperture found in the handle or lower limb 1010 of the illustrated compound bow 1000 and receives a threaded set screw 1040 therein. The aperture/pin 1040 combinations are found in compound bows for releasable attachment of available bow accessories thereto. Upon such reception with plate 105 therebetween a coupling nut 1050 is attached thereto. The coupling nut 1050 is threaded onto the free end of set screw 1040. Nut 1050 presents an aperture 1055 at its free end. This aperture 1055 presents an aperture for reception of the conventional set screw associated with a stabilizer or other accessory. Thus, the use of my protector 10 does not preclude the use of other accessories.

Projecting from the mounting arm 110 is the arm guard 200. The elongated arm guard 200 is attached to the mounting arm 110 by means of nut/bolt combinations 150. This structure allows the arm guard 200 to be selectably angled relative to the mounting arm 110 by the archer. Although dual pivots are shown a single central pivot may be used, if so desired.

The plurality of apertures 120 included in the mounting plate 105 allows for adjustment of the protector 10 relative to the bow 1000 and arm 1090 of the archer. Thus, the plurality of apertures 120 allows for lateral and vertical placement of the protector 10 relative to the bow 1000 by alignment of a selected one of the mounting plate apertures with the accessory aperture and subsequent accessory aperture/set screw 1040/coupling nut 1050 engagement. These apertures 120 may be replaced by an elongated lateral or vertical slot or slots so as to provide a continuous range of adjustment. This alignment allows my device 10 to be used with a wide range of bows which may have the accessory aperture placed in different positions along the limb 1040 of the bow 1000.

Furthermore, the guard 200 may be adjusted from a position in longitudinal alignment with the mounting arm 110 to a position relatively angled thereto. This function allows the archer to adjust the guard 200 of protector 10 to a position desired by the archer. Thus, some archers may prefer a general longitudinal alignment between arm 100 and guard 200 while others may desire an angular relationship. Ideally, the guard should pass along the archer's forearm 1090 at the zone where the central stretch 1060 crosses the arm. This zone is usually the point of contact of the central stretch 1060 with the user's forearm 1090 during shooting. This angular adjustment of guard 200 cooperates with the ability to adjust the entire device 10 in lateral and vertical directions, as provided by the plurality of the apertures 120. These functions allow the archer to adjust the device 10 to his/her own preference.

It is here noted that the mounting plate 105/aperture 120 combination allows the mounting arm 100 to be mounted with either left handed or right handed archery bows to protect the respective opposed forearms of the left handed or right handed archer.

It is also noted that the archer may press his forearm against guard 200 during use. The pressure of the arm against guard 200 helps to stabilize the bow during aiming and shooting and also diminishes any twisting forces which may act on the bow 1000 during use.

Figure 7:
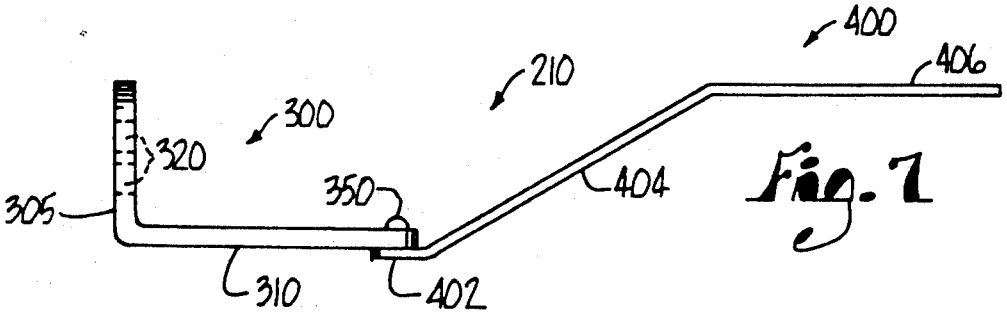
FIG. 7 is a top view of an alternative embodiment of a protector.
Figure 9:
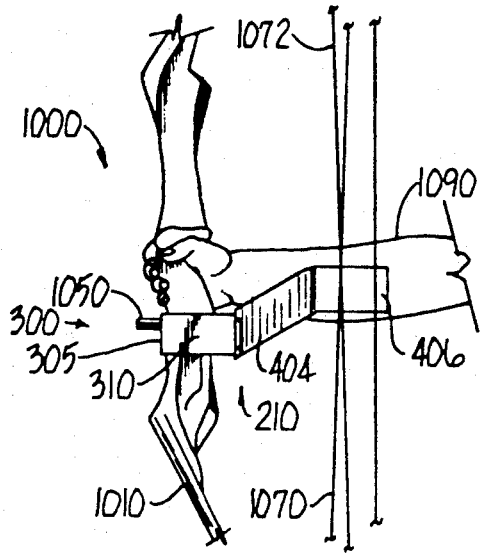
FIG. 9 is a side view of the protector set forth in FIG. 7 on a reduced scale, as affixed to a fragmentarily shown compound bow, to protect the right forearm of a left handed bowyer.

FIGS. 7 and 9 illustrates a second embodiment of a protector 210. As such, the protector has a mounting arm 300 and an arm guard 400 attached to arm 300 by means of bolt/nut 350 combinations.

Figure 3:
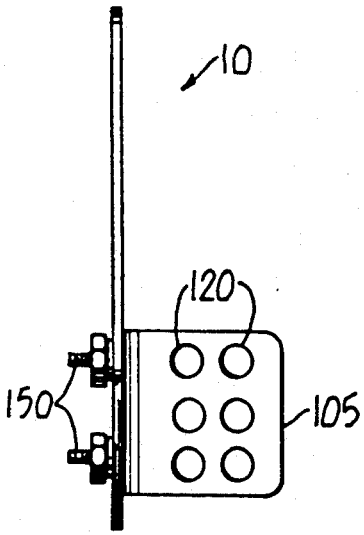
FIG. 3 is a front elevation view of the protector in FIG. 1.
Figure 4:
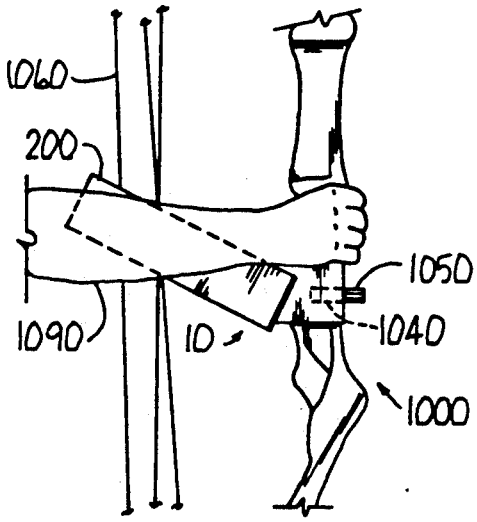
FIG. 4 is a side elevation view of the protector on a reduced scale, as affixed to a fragmentarily shown compound bow, to protect the right forearm of a left handed bowyer.
Figure 5:
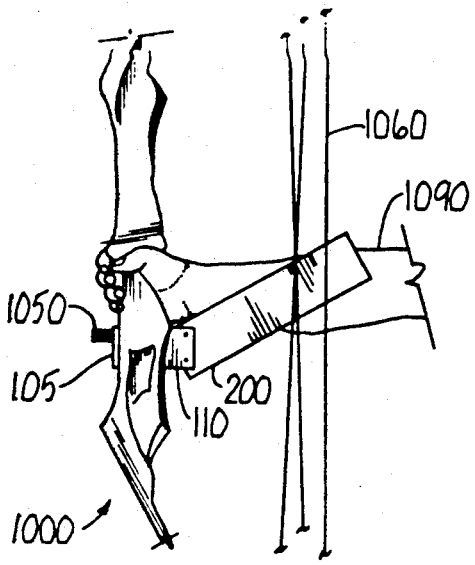
FIG. 5 is an opposed view of the protector as shown in FIG. 4.
Figure 6:
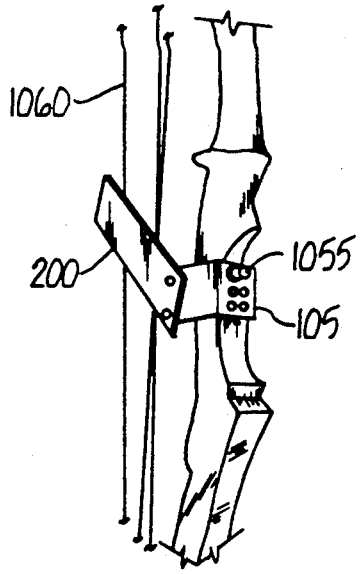
FIG. 6 is a perspective view of the protector as shown in FIGS. 4 and 5.

The mounting arm 300 includes a front mounting plate 305 and rearwardly extending mounting strut 310 similar, if not identical, to mounting plate 105 and arm 110 as shown in FIG. 3. The mounting plate 105 thus includes a plurality of apertures 320 aligned in vertical and horizontal directions similar to apertures 120 in plate 105. These apertures are designed for alignment with the accessory aperture found in the handle or lower limb 1010 of the compound bow 1000 and receives the threaded set screw 1040 therein. The aperture/pin 1040 combination is found in compound bows for releasable attachment of various bow accessories thereto. Again, upon extension of screw through plate 305 and into the accessory aperture a coupling nut 1050 is threaded onto the free end of set screw 1040. Nut 1050 presents an aperture for reception of the conventional set screw therein so as to attach other accessories. The use of protector 210 does not preclude the use of other accessories.

Projecting from the mounting strut 310 is the arm guard 400. The arm guard is attached to the mounting arm 310 by means of bolt/nut combinations 350. As best seen in FIG. 7, arm guard 400 includes a mounting section 402, an angled section 404 and the protector section 406.

As best shown in FIG. 9, the mounting arm 300 of arm guard 210 is mounted to the bow 1000 upon extension of the set screw 1040 through one of the apertures 320 in the mounting plate 305 and into the accessory aperture. In embodiment 210 the mounting strut 310 extends rearwardly to the archer on the side of the bow opposite the arm to be protected. As such arm guard 400 is configured so as to cross the handle of the bow 1000. Thus, section 404 is angled so as to extend between the handle of the bow and end stretches/cables 1070, 1072. Thus, the protector section 406 is positioned adjacent the forearm 1090 of the archer to be protected as shown in FIG. 9. This embodiment is useful so as to position the mounting arm 310 and portions of the guard 400 away from the hand and wrist of the holding arm of the archer.

Figure 8:
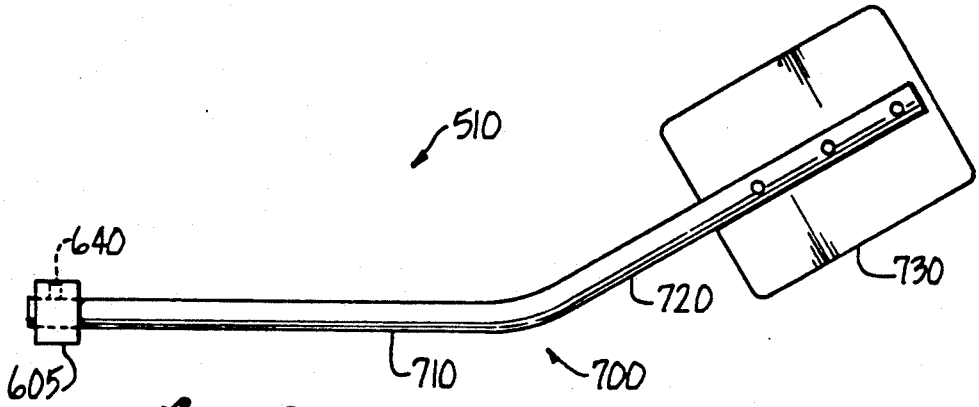
FIG. 8 is a side view of a third alternative embodiment of a protector.
Figure 10:
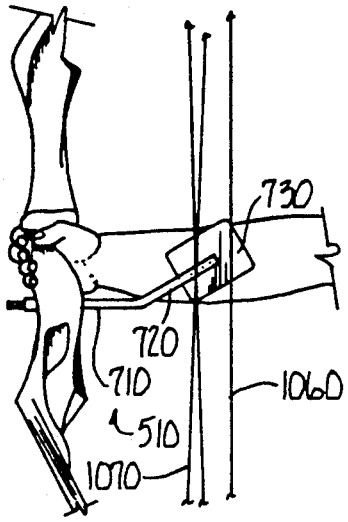
FIG. 10 is a side view of the protector set forth in FIG. 8 on a reduced scale, as affixed to a fragmentarily shown compound bow, to protect the right forearm of a left handed bowyer.
Figure 11:
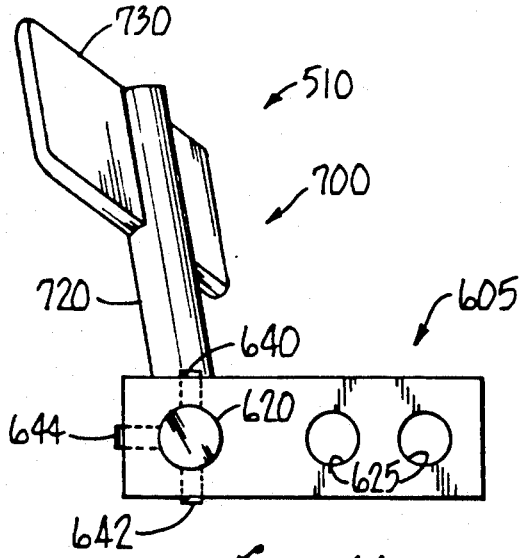
FIG. 11 is a front elevation view of the protector shown in FIG. 8 on an enlarged scale.

FIGS. 8, 10 and 11 illustrate a third embodiment of the protector 510. This embodiment 510 presents a mounting plate 605 which is attached to the accessory aperture of the compound bow by a set screw 1040/coupling nut 1050 combination as above described. The set screw 1040 extends through one of the mounting apertures 625 and into the accessory aperture with the coupling nut 1050 attached to the free end thereof. The arm guard 700 is attached to the mounting plate 605 by extension of rod 710 through aperture 620 in mounting plate 605. A plurality of horizontal and vertical set screws 640, 642, 644 extend through apertures in plate 605 and bear against rod 710 so as to hold the same in place. Extending from rod 710 is an angled rod 720 with a generally rectangular protector plate 730 thereon. Upon attachment of the mounting plate 605 to the accessory aperture the rod 710 is rotated by the archer within aperture 620 so as to place protector plate 730 in a desired relationship relative to the holding forearm 1090 of the archer. Once so positioned the set screws 640, 642, 644 are tightened to hold the rod 710 and attached plate 730 in the desired position so as to protect the forearm of the user from bowstring 1060 during use.

The use of both of the alternative embodiments 210, 510 result in advantages similar, if not identical, to the embodiment 10.

It is to be understood that while certain forms of this invention have been illustrated and described, it is not limited thereto, except in so far as such limitations are included in the following claims and allowable functional equivalents thereof.

Having thus described the invention, what is claimed as new and desired to be secured by Letters Patent is:

1. A protector for a forearm of an archer holding a handle of an archery bow, the handle comprising a front wall facing away from the archer, a rear wall facing the archer and a pair of side walls extending between the handle front and rear walls and towards the archer, said protector comprising:

a mounting arm, said mounting arm comprising:

a mounting plate having a plurality of apertures aligned and spaced both laterally and vertically on said mounting plate for mounting to the front wall of the handle of the bow facing away from the archer for both lateral and vertical placement of said mounting plate;

a mounting strut having first and second ends and extending from said mounting plate, said mounting strut first end extending generally normal to said mounting plate;

means for mounting said mounting plate to the front wall of the handle with said mounting strut extending towards said archer, said mounting plate generally traversing the front wall of the handle, to laterally displace said mounting strut relative to one of the side walls of the handle;

an arm guard;

pivot means for pivotally attaching said arm guard to said second end of said mounting strut for pivotal vertical movement, said pivot means vertically positioning said arm guard adjacent the archer's forearm during use.

2. The apparatus as claimed in claim 1 further comprising:

said plurality of apertures in said mounting plate with one of said apertures being aligned with an accessory aperture positioned in the front wall of the handle of the bow, said mounting means being presented by a pin for extension through one of said mounting plate apertures and engagement with the bow aperture with said mounting plate therebetween.

3. The apparatus as claimed in claim 2 wherein said plurality of mounting plate apertures are aligned in at least a vertical direction whereby said alignment of one of said mounting plates apertures with said bow aperture adjusts said protector in vertical directions relative to said bow aperture and the bow handle.

4. The apparatus as claimed in claim 2 wherein said plurality of mounting plate apertures are aligned in at least a lateral direction, whereby said alignment of one of said apertures with said bow aperture adjusts said protector in lateral directions relative to said bow aperture and the bow handle.

5. The apparatus as claimed in claim 2 wherein said plurality of mounting plate apertures are aligned in vertical and lateral directions whereby to likewise align said protector relative to said bow aperture and the low handle.

6. The apparatus as claimed in claim 2 wherein said arm guard is positioned in a bearing relationship with said archer's forearm, said relationship stabilizing said bow during use.

7. The apparatus as claimed in claim 2 wherein said plurality of apertures are symmetrical about a transverse axis through said mounting plate, said symmetrical apertures allowing said mounting means to mount said protector to a right handed or left handed bow.

8. The apparatus as claimed in claim 1 wherein said mounting means comprises:

an aperture in the front wall of the handle of the bow; and a pin having first and second ends for extension through said mounting plate, said second end releasably engaging said bow aperture with said mounting plate extending across the front wall of the handle of the bow.

9. The apparatus as claimed in claim 8 further comprising:

a nut engageable with said first end of said pin, said nut presenting an aperture to said archer for engagement of a bow accessory thereto.

10. A protector for the forearm of an archer holding a handle of an archery bow, the handle comprising a front wall facing away from the archer, a rear wall facing the archer and a pair of side walls extending between the handle front and rear walls and towards the archer, the protector comprising:

a mounting bracket, said mounting bracket comprising:

a mounting plate having a plurality of apertures aligned and spaced both laterally and vertically on said mounting plate for attachment to the front wall of the bow handle facing away from the archer for both lateral and vertical placement of said mounting plate;

a mounting strut normally extending from said mounting plate and presenting a first end;

means for selectably mounting said mounting plate to the front wall of the handle of the bow with said associated mounting strut in selectable lateral and vertical displacements relative to the front and side walls of the bow handle with said mounting strut extending towards said archer;

an arm guard;

pivot means for pivotally attaching said arm guard to said first end of said mounting strut for pivotal vertical movement, said arm guard being vertically positioned adjacent said archer's forearm during bow use.

11. A protector for the forearm of an archer grasping a handle of an archery bow the handle including a front wall facing away from the archer, a rear wall facing the archer and a pair of side walls extending between the front and side walls and towards the archer, the protector comprising:

a mounting arm, said mounting arm comprising:

a mounting plate having a plurality of apertures aligned and spaced both laterally and vertically on said mounting plate for attachment to the front wall of the bow handle facing away from the archer for both lateral and vertical placement of said mounting plate;

a mounting strut extending from said mounting plate and generally normal thereto;

means for mounting said mounting plate to the front wall of the handle of the bow with said mounting strut extending towards said archer from a side wall of the handle of the bow opposite the forearm of said archer;

an arm guard;

pivot means for pivotally attaching said arm guard to said mounting strut for pivotal vertical movement, said pivot means having structure crossing the rear wall of the bow handle for vertically positioning said arm guard at a position adjacent the same side of the bow handle as the grasping forearm, whereby to position the arm guard adjacent said archer's forearm during use.

12. A protector for the forearm of an archer holding a handle of an archery bow the handle including a front wall facing away from the archer, a rear wall facing the archer and a pair of side walls extending between the front and side walls and towards the archer, the protector comprising:

a mounting arm, said mounting arm comprising a mounting plate having a plurality of apertures aligned and spaced both laterally and vertically along said mounting plate for mounting to the front wall of the bow handle facing away from the archer for lateral placement of said mounting plate;

means for mounting said mounting plate to the bow handle in a position generally traversing the front wall of the bow handle;

an arm guard having a first section mounted and extending normally from said mounting plate and a second section extending at an angle relative to said first section;

at least one aperture extending transversely through said mounting plate for rotatably mounting said arm guard to said mounting plate and for positioning said second section relative to said archer's forearm during use.

13. The apparatus as claimed in claim 12, wherein said arm guard comprises:

a rod having a first end;

a protector plate on an opposed end of said rod, said plate positioned adjacent said archer's forearm during use.

14. The apparatus as claimed in claim 13 wherein said rotatable mounting means comprises:

said at least one aperture in said mounting plate being displaced from a side wall of the handle for receiving a portion of said rod first end in rotatable movement therein;

at least one set screw extending into said aperture;

said set screw bearing against said rod first end to hold said rod in place and said protector plate thereon.

* * * * *

UNITED STATES PATENT AND TRADEMARK OFFICE

CERTIFICATE OF CORRECTION

PATENT NO. : 5,137,008

DATED : August 11, 1992

INVENTOR(S) : Anthony Taylor

It is certified that error appears in the above-identified patent and that said Letters Patent is hereby corrected as shown below:

Column 5, line 26, delete "plates" and substitute --plate--.

Column 5, line 38, delete "low" and substitute --bow--.

Column 6, line 60, delete "both" and "and vertically".

Signed and Sealed this

Seventeenth Day of August, 1993

*Attest:*

*Attesting Officer*

BRUCE LEHMAN

*Commissioner of Patents and Trademarks*